US006845601B1

(12) United States Patent
Linner et al.

(10) Patent No.: US 6,845,601 B1
(45) Date of Patent: Jan. 25, 2005

(54) METHOD AND ARRANGEMENT FOR TRANSFERRING PACKAGING CONTAINERS FROM A FIRST UNIT TO A SECOND UNIT

(75) Inventors: Hans Linner, Kalmar (SE); Jan Nilsson, Kalmar (SE)

(73) Assignee: Norden Pac Development AB (SE)

( * ) Notice: Subject to any disclaimer, the term of this patent is extended or adjusted under 35 U.S.C. 154(b) by 0 days.

(21) Appl. No.: 09/980,730

(22) PCT Filed: Apr. 26, 2000

(86) PCT No.: PCT/SE00/00782

§ 371 (c)(1),
(2), (4) Date: Mar. 27, 2002

(87) PCT Pub. No.: WO00/69724

PCT Pub. Date: Nov. 23, 2000

(30) Foreign Application Priority Data

Apr. 30, 1999 (SE) ..... 9901555

(51) Int. Cl.[7] ..... B65B 5/00; B65G 47/24; B66C 1/42

(52) U.S. Cl. ..... 53/473; 53/475; 53/251; 53/448; 53/567; 53/253; 198/409; 294/87.1

(58) Field of Search ..... 53/473, 475, 251, 53/448, 567, 253; 198/409; 294/87.1

(56) References Cited

U.S. PATENT DOCUMENTS

| | | | | | |
|---|---|---|---|---|---|
| 3,552,582 | A | * | 1/1971 | Hanft | 414/739 |
| 3,574,986 | A | * | 4/1971 | Dieter | 53/473 |
| 3,729,888 | A | | 5/1973 | Carle | |
| 3,854,270 | A | * | 12/1974 | Cloud et al. | 53/540 |
| 4,045,940 | A | * | 9/1977 | White et al. | 53/447 |
| 4,051,652 | A | | 10/1977 | Hirano et al. | |
| 4,558,555 | A | * | 12/1985 | Rueff et al. | 53/493 |
| 4,627,216 | A | * | 12/1986 | Argazzi | 53/251 |
| 4,827,692 | A | | 5/1989 | Fiske et al. | |
| 4,832,180 | A | * | 5/1989 | Ferrero | 198/468.3 |
| 5,257,888 | A | * | 11/1993 | Kronseder | 414/416.06 |
| 5,290,134 | A | * | 3/1994 | Baba | 414/404 |
| 5,471,738 | A | * | 12/1995 | Burcham et al. | 29/701 |
| 5,584,160 | A | * | 12/1996 | Andrea | 53/251 |
| 5,611,193 | A | | 3/1997 | Farrelly | |
| 5,655,355 | A | * | 8/1997 | Ramler | 53/475 |
| 6,141,943 | A | * | 11/2000 | Hart et al. | 53/444 |
| 6,210,093 | B1 | * | 4/2001 | Hannen et al. | 414/226.01 |

FOREIGN PATENT DOCUMENTS

GB 2 022 553 12/1979

* cited by examiner

*Primary Examiner*—Scott A. Smith
*Assistant Examiner*—Brian Nash
(74) *Attorney, Agent, or Firm*—Lerner, David, Littenberg, Krumholz & Mentlik, LLP

(57) ABSTRACT

The invention relates to a synchronizing method and transfer arrangement for synchronizing the patterns of movement between two units included in a packaging line, where one unit is driven intermittently and the other continuously. The invention relates in particular to a transfer arrangement between an intermittently operating tube filler and a continuously operating cartoning machine. The transfer arrangement has a frame arrangement (13) intended to support tube pickers/placers (28) and arranged for a pivoting movement about a horizontal axis (16) and for a turning movement about a vertical axis (17). The turning movement about the axis (17) gives an acceleration course for the frame in a position in front of the tube release station, and this turning movement generating acceleration is obtained by an axially acting cam guide (32). The latter is designed so that the tube pickers/placers in the release position are given the same speed as the case conveyor of the cartoning machine.

25 Claims, 8 Drawing Sheets

METHOD AND ARRANGEMENT FOR TRANSFERRING PACKAGING CONTAINERS FROM A FIRST UNIT TO A SECOND UNIT

FIELD OF THE INVENTION

The invention relates to a method and an arrangement for transferring packaging containers, in particular packaging tubes, from a first unit operating intermittently in a first horizontal path to a second unit operating continuously in a second horizontal path.

The invention relates in particular to a method and arrangement for transferring filled tubes from a tube filler, operating in a horizontal circular path and provided with a plurality of filling nozzles, to a continuously operating cartoning machine.

PRIOR ART

It has for many years been known to handle packaging containers, and in particular packaging tubes, using the so-called pick-and-place principle. This principle is used, for example, for collecting packaging tubes downstream of a filler, and the principle is applied in such a way that the tubes, downstream of the filler, are placed in a so-called "stepped conveyor", i.e. a belt provided with a number of cases.

To be able to handle a continuously operating conveyor belt with these cases, some form of transfer arrangement is needed which can handle the transition between intermittent feeding of packaging containers and continuous feeding.

A method for doing this is the so-called drop-flap principle. In this, a flap device is inserted between a conveyor belt serving as buffer belt, in which packaging containers are continuously fed with a certain spacing between them, and a continuously operating conveyor belt provided with "cases". To be able to drop the packaging containers into the associated cases on the continuously driven belt, precise control of the flaps is required so that these are opened at the correct moment and a tube falls into the correct case. This method is relatively common, but it has the inherent disadvantage that one has to rely on gravity, and in addition to this the arrangement is such that friction always remains an uncertain factor.

Another principle is based on a "rotating drum". A drum provided with suitable recesses corresponding to the container shape is in this case inserted between a delivery conveyor, on which tubes are advanced with a certain spacing between them, and a "case conveyor". The conveyor provided with cases is arranged under this drum, and the speed of rotation of the rotating drum is adapted in such a way that as soon as one of the recesses is situated over a case, a packaging container drops into the case.

Problem on which the Invention is Based

The trend in the packaging machines sector is towards ever higher production capacity and thus higher speeds. A specific problem in this connection is the inadequacy of known transfer arrangements, for example of the above-mentioned type, where during the transfer phase from one unit to another, for example from filler to cartoning machine, there is insufficient control of the packaging container. The gravitation principle can of course be used for insertion into the respective case, but during the actual transfer phase problems may arise due to the fact that the packaging containers are not continuously and positively gripped.

The object of the invention is therefore to make available a solution in which this disadvantage is eliminated, and which solution can be generally applied for synchronizing the transfer of packaging containers from one movement path to another with complete control, and gripping of the containers throughout the entire transfer phase.

THE INVENTION

The object of the invention is achieved by means of a method and an arrangement as specified in attached patent claims 1 and 12, respectively.

DESCRIPTION OF A PREFERRED EMBODIMENT

Figure 4:
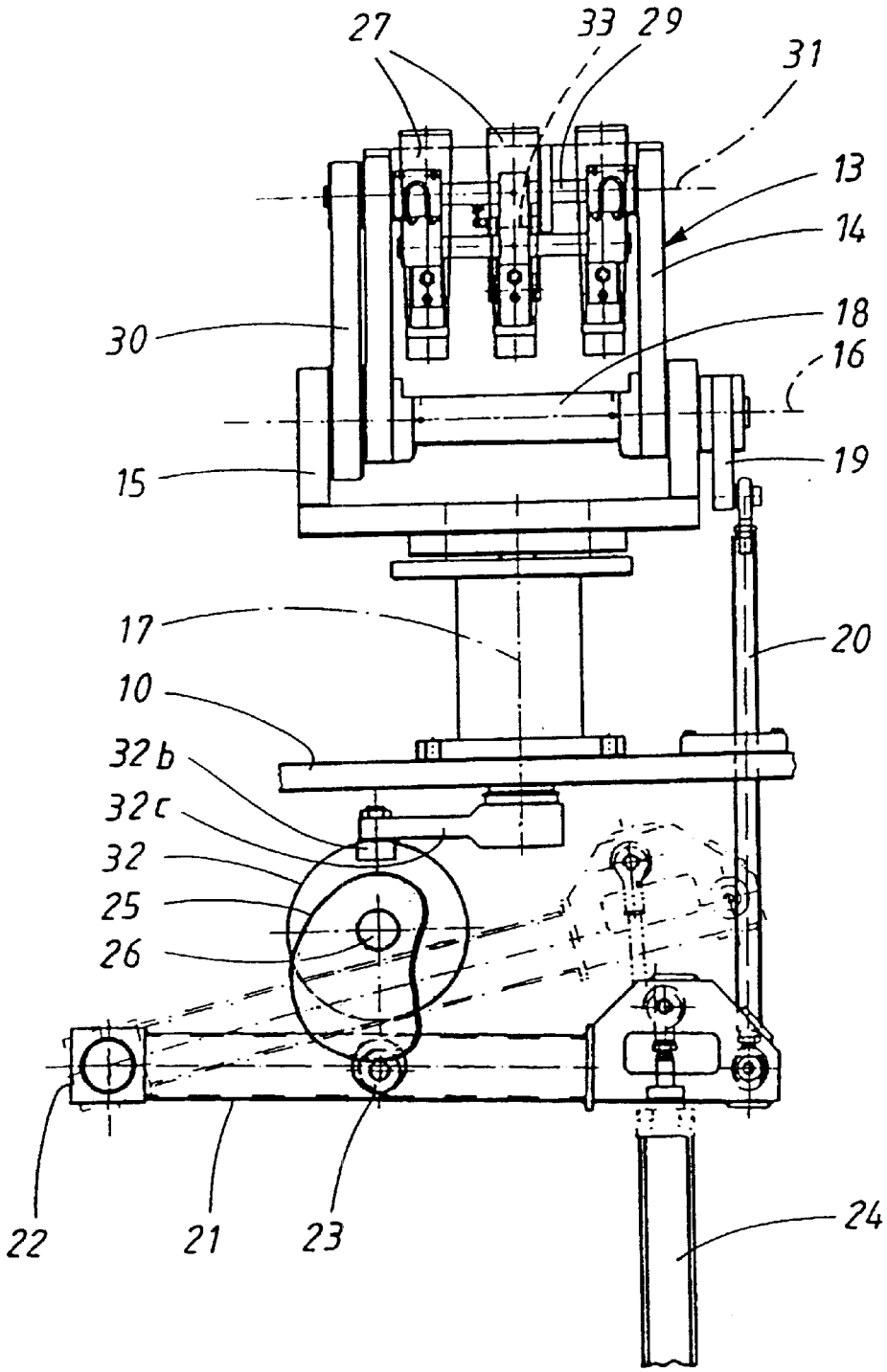
FIG. 4 is a diagrammatic outline view showing the main components of the transfer arrangement.

Referring first to FIG. 4, the main components of a transfer arrangement according to the invention are shown here. The transfer arrangement is supported on a machine stand 10 at a suitable distance between an intermittently operating filler (FIG. 5) and a continuously operating so-called case conveyor 12 (FIG. 9) in a cartoning machine. Supported on the stand 10, there is a frame arrangement 13 which comprises a first frame 14 and a second frame 15. The frame 14 can pivot about a pivot axis 16, and the frame 15 can turn about an axis of rotation 17.

To generate the pivoting of the frame 14 about the pivot axis 16, the frame 14 is fixed in terms of rotation on a shaft 18 mounted in the frame 15. Arranged in a rotationally fixed manner on this shaft 18, there is an arm 19 which is connected to an articulated rod 20. The other end of the articulated rod is connected to a cam follower arm 21 which at its other end is mounted in a bearing 22 in the machine stand. On the cam follower arm there is a cam follower roller 23, and a piston/cylinder 24 acting with a spring force loads the arm 21 and the cam follower roller 23 against a cam plate 25 which in turn is fixed in terms of rotation on a drive shaft 26. As will be seen from the figure, the cam plate 25 acts peripherally, and its peripheral design generates, upon rotation of the shaft 26, a reciprocating movement of the cam follower arm 21 between the position indicated by continuous lines and the position indicated by broken lines, and this in turn results in upward and downward movement of the articulated rod 20 and thus a reciprocating rotational movement of the shaft 18 and the frame 14 secured thereon.

Figure 5:
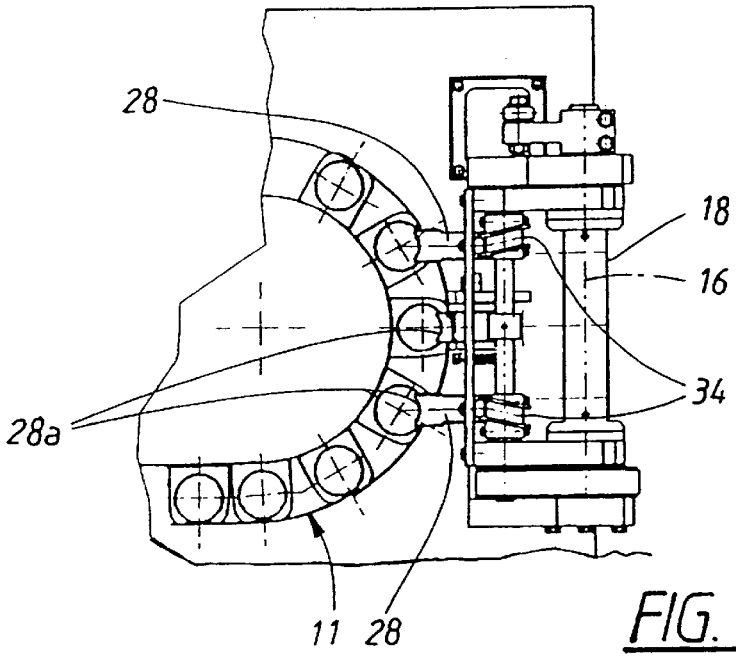
FIG. 5 is a diagrammatic outline view showing the transfer arrangement in position for picking up tubes in a tube filler.
Figure 6:
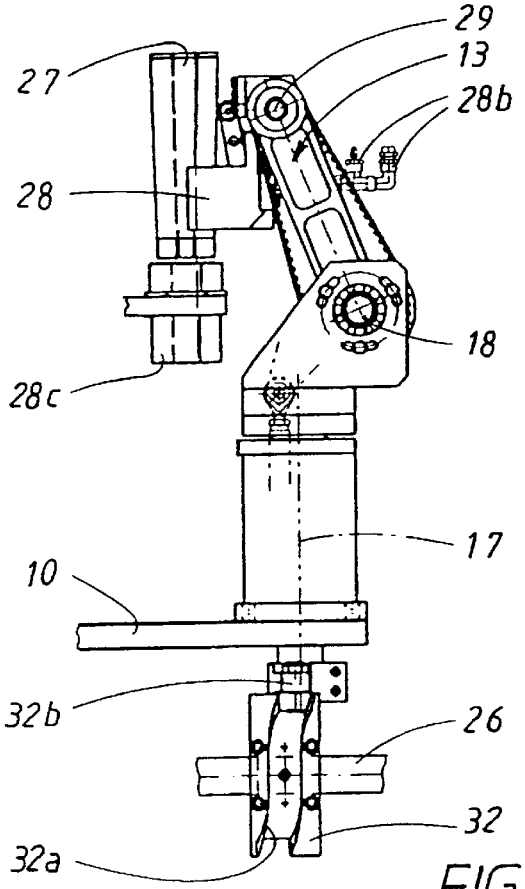
FIG. 6 shows the transfer arrangement from FIG. 5, seen from the side.

FIG. 4 shows three tubes 27 mounted in a rotationally fixed manner on a shaft 29 of a tube picker/placer 28 (FIG. 5). The shaft 29 is driven by a cam belt 30 and acquires its reciprocating rotational movement from the shaft 18 driven by the articulated rod 20. The tube pickers/placers 28 on the shaft 29 execute a pivoting movement to and fro about the pivot axis 31.

Figure 9:
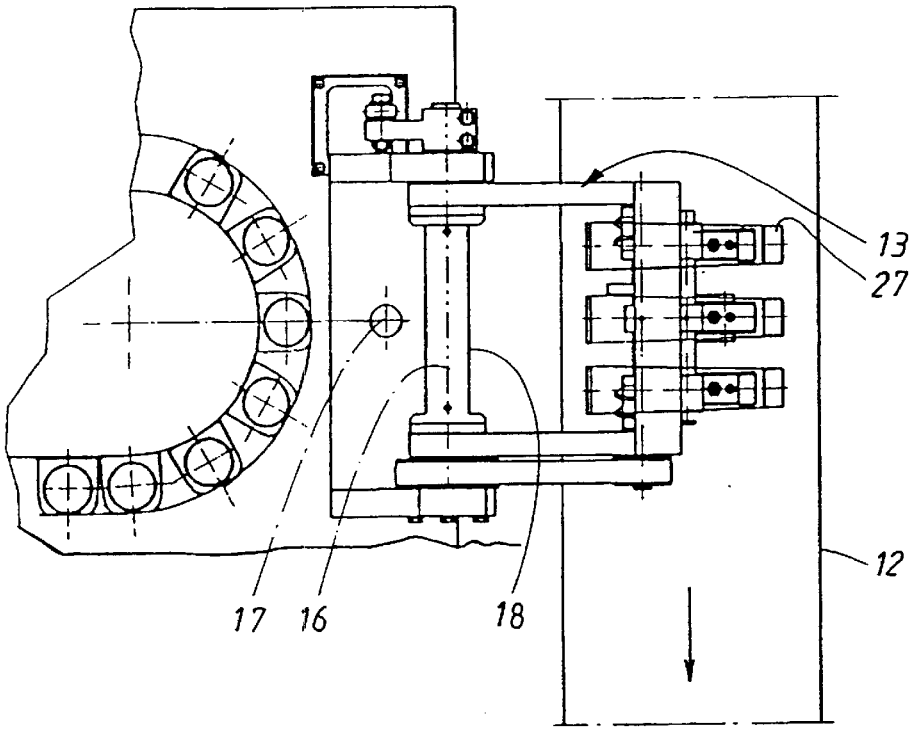
FIG. 9 shows the transfer arrangement pivoted forwards to the conveyor of the cartoning machine, with the tubes accelerated to the conveyor's speed and horizontally oriented with the correct mutual spacing for placement in cases on the conveyor.

During the pivoting movement forwards to the tube release position and back to the tube pick-up position, the tubes are thus given a pivoting movement which is determined by a combination of the pivoting movement of the frame 14 and the pivoting movement of the tube pickers/placers about the pivot axis 31, obtained from the driving of the shaft 29 by the cam belt 30. By designing the radially acting cam plate 25 in a corresponding manner, and by using the articulated rod 20 to give the shaft 18 the necessary turning movement and thus the cam belt 30 the appropriate transmission ratio, the whole set-up is such that by means of the pivoting movement, or tilting movement, of the frame arrangement 14, the tubes 27 are picked up in a vertical position in the tube filler and these tubes are delivered horizontally to the conveyor of the cartoning machine (FIG. 9).

In addition to the described pivoting or tilting movement of the frame 14 and the tube pickers/placers 28, an arrangement is provided for limited turning of the frame 15 about the axis of rotation 17, which, as can be seen from FIG. 4, is oriented vertically and centrally in the transfer arrangement. Arranged for this purpose on the drive shaft 26, there is a further cam plate 32 which is of the axially acting type (see FIG. 8, for example). Running in the cam plate track 32*a* provided for specific movement, there is a cam follower roller 32*b* which is arranged on an arm 32*c* connected in a rotationally fixed manner to a shaft (not shown) arranged in a rotationally fixed manner in the frame 15, in order, during movement of the arm 32*c* in the track 32*a*, to give the frame 15 a reciprocating rotational movement about the axis of rotation 17.

Figure 7:
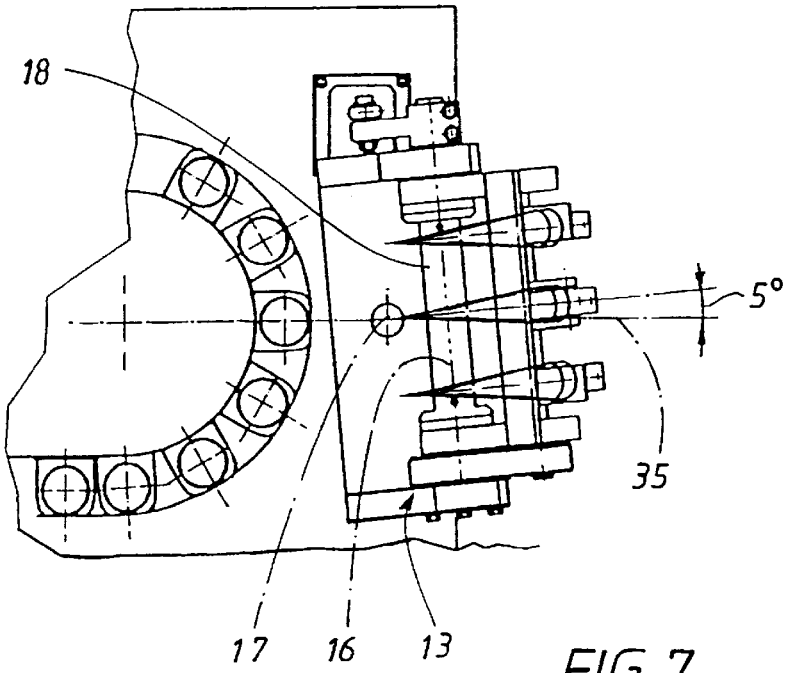
FIG. 7 shows the transfer arrangement in an intermediate position, with the frame arrangement which holds the filled tubes in a position ready for acceleration movement.

Thus, as will be described below, during the pivoting or tilting movement of the frame arrangement 13, a turning movement about the axis of rotation 17 is superimposed on the pattern of movement, and this turning movement plays an important part in this context. In fact, during the continuous pivoting of the frame 13 from pick-up position to release position, it is possible by this means to create an acceleration course for the tube pickers/placers at exactly the right moment, namely immediately before the tubes are to be released to the continuously driven conveyor in the cartoning machine. It has in fact been found in practice that by suitable design of the axially acting cam track arrangement 32*a* in the cam plate 32 and by corresponding adaptation of the arm 32*c*, a moderate acceleration course is sufficient to synchronize the movements. FIG. 7 shows, for example, a 5° turn of the frame arrangement 13 for generating an acceleration course to the cartoning machine which, in the example shown, delivers 300 tubes per minute (3 tube pickers/placers).

In addition to this acceleration, however, it is also necessary to be able to handle the positions of the tube pickers/placers on the shaft 29 all the way from the pick-up position (FIG. 5) to the release position. In the illustrative embodiment shown in the drawings, filled tubes are in fact picked up from a embodiment shown in the drawings, filled tubes are in fact picked up from a partially circular path (FIG. 5) in the tube filler and released to a straight path. In addition, the spacing between adjacent tubes on the partially circular path differs from the spacing between adjacent tubes which is defined by the cases on the conveyor 12.

In the illustrative embodiment shown in the drawings, there are three tube pickers/placers on the shaft 29, and the whole set-up is arranged in such a way that the central tube picker/placer is fixed centrally on the shaft 29 while the outer pickers/placers can be moved along the shaft 29. The length of the outer pickers/placers viewed from the shaft 29 and radially outwards is constant and adapted to the prevailing machine parameters in order to permit the described transfer movement. By contrast, the central picker/placer is articulated about a shaft 33 parallel to the shaft 29. In the pick-up position according to FIG. 5, the central picker/placer will in fact have a shorter length than it does in the release position according to FIG. 9, where all the pickers/placers have the same radial extent viewed from the shaft 29. This articulation 33 is controlled from a fixed cam arrangement (not shown) during the turning of the shaft 29.

In order also to control the necessary axial displacement of the outer pickers/placers, these are arranged in axially acting cam guides 34 fixed in terms of rotation on the shaft 29 (FIG. 5). During the turning of the shaft 29 by means of the cam belt 30, the axially acting guides 34 move the outer pickers/placers towards the central picker and, as has been mentioned above, at the same time the radial length of the central picker/placer viewed from the shaft 29 will be lengthened. After the frame arrangement 13 has been pivoted or tilted to the position according to FIG. 9, the spacing between the tubes is thus identical to the spacing on the conveyor 12, and at the same time the circle configuration, in which the tubes originally lie according to FIG. 5, has been converted to a rectilinear configuration. During the pivoting of the frame arrangement 13, the original configuration in the form of an arc of a circle is successively straightened out and the axially acting guides will compensate for the height difference between the central picker/placer and the two outer pickers/placers, so as finally, and in a well-ordered manner, by means of the frame arrangement, to allow the tubes to be placed in the cases on the conveyor 12.

Each picker/placer has a cup-shaped recess 28*a* adapted to the contour of the tubes, and the tubes are fixed in position by means of vacuum attachments 28*b* all the way from pick-up according to FIG. 5 to release according to FIG. 9. This provides positive in-built security against failure and gives the exact position of each tube throughout the entire process.

For those aspects of the transfer process which have not already been discussed above, reference is made to FIGS. 5 to 12 which show a complete transfer cycle.

Thus, in FIG. 5, filled tubes are picked up from a partially circular path of an intermittently operating tube filler, three tubes at a time. The pickers/placers 28 have in this case a positioning corresponding to the partially circular configuration of the tubes, with the central picker/placer drawn back by turning about the articulation 33 (FIG. 4). The frame arrangement 13 is in the position shown in FIG. 6. The vacuum is established via attachments 28*b* and the cavities 28*a* engage the tubes via elastic inserts 28*d* (FIG. 1) after these have been lifted by ejectors (not shown) in tube holders 28*c* in the filler 11.

FIG. 7 shows an intermediate position during the pivoting movement of the frame arrangement 13 forwards to the position according to FIG. 9. In this intermediate position, the axially acting cam guide 32, by turning about the axis of rotation 17, has effected a 5° turn of the frame arrangement 13 anti-clockwise from the line 35. The frame arrangement, with the pickers/placers arranged thereon, is thus in a starting position for commencement of an acceleration movement in the clockwise direction under the control of the axially acting cam guide 32. By suitable design of the latter, it has been found that a 5° turn about the axis of rotation 17 is sufficient for the pickers/placers to assume a peripheral speed, in the position according to FIG. 9, corresponding to the speed of the conveyor 12. Since the spacing between the pickers/placers corresponds to the spacing of the cases on the conveyor, and in addition since the tubes are oriented in a straight line, these tubes can be easily dropped into the respective case by interrupting the vacuum to the attachments 28*b*.

Figure 8:
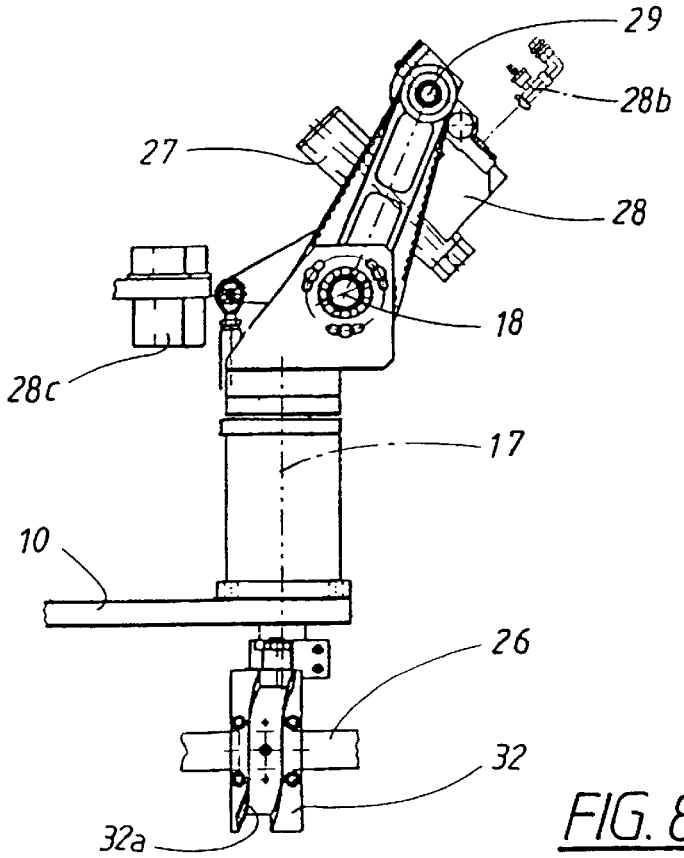
FIG. 8 shows the transfer arrangement from FIG. 7, seen from the side.

FIG. 8 shows, in a side view, the position of the frame arrangement 13 and associated parts.

Figure 10:
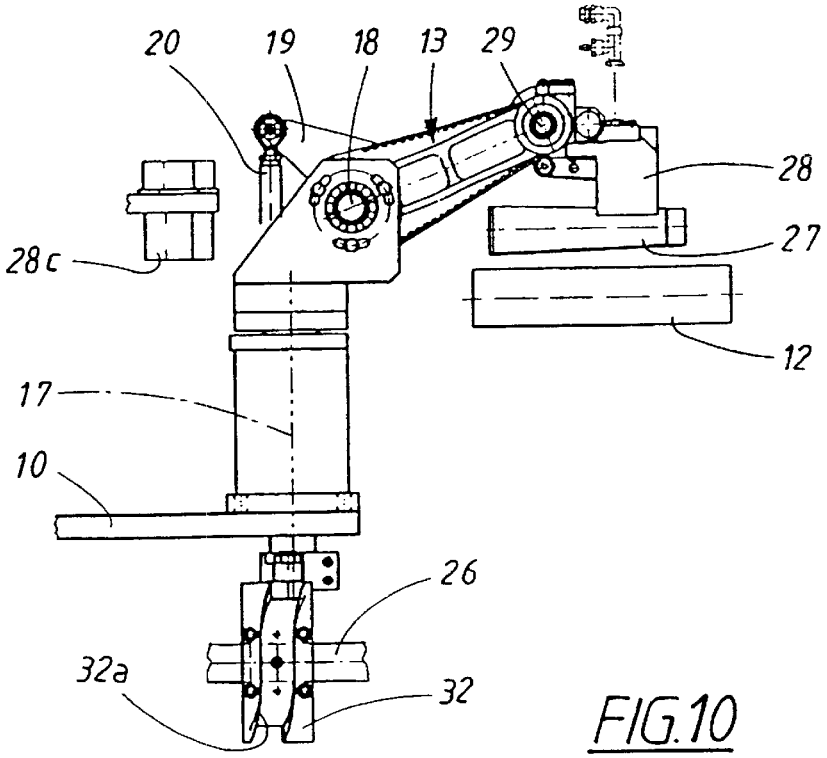
FIG. 10 shows the transfer arrangement from FIG. 9, seen from the side.

As has already been mentioned, the tubes in the position according to FIG. 9 are oriented horizontally and with the necessary spacing, and the frame arrangement 13 is in the position shown in FIG. 10.

Figure 11:
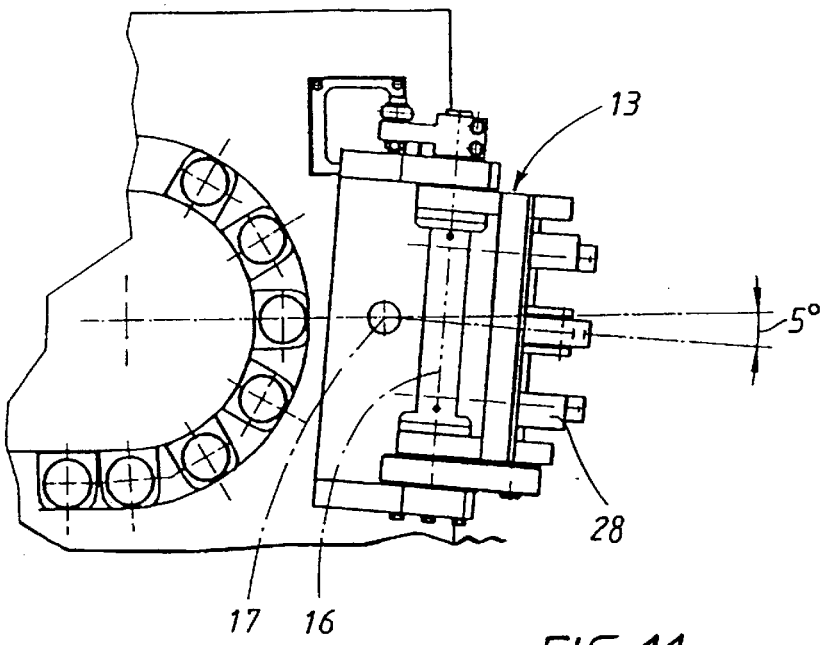
FIG. 11 shows the transfer arrangement in an intermediate position, on the way back towards the pick-up position, with the frame arrangement now without tubes, at the end of a deceleration phase.
Figure 12:
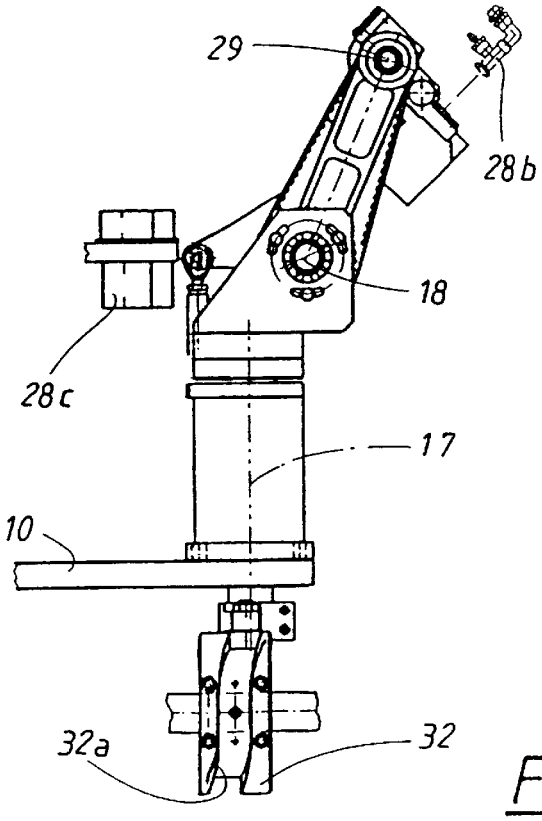
FIG. 12 shows the transfer arrangement from FIG. 11, seen from the side.

After the tubes have been released, the frame arrangement 13 gradually assumes a position according to FIG. 11. This position represents an intermediate position in which the frame arrangement 15 has been turned about the axis of rotation 17 by means of the axially acting cam guide in order, during a turning movement of 5°, to permit deceleration of the turning movement of the frame about the axis of rotation 17.

Figure 1:
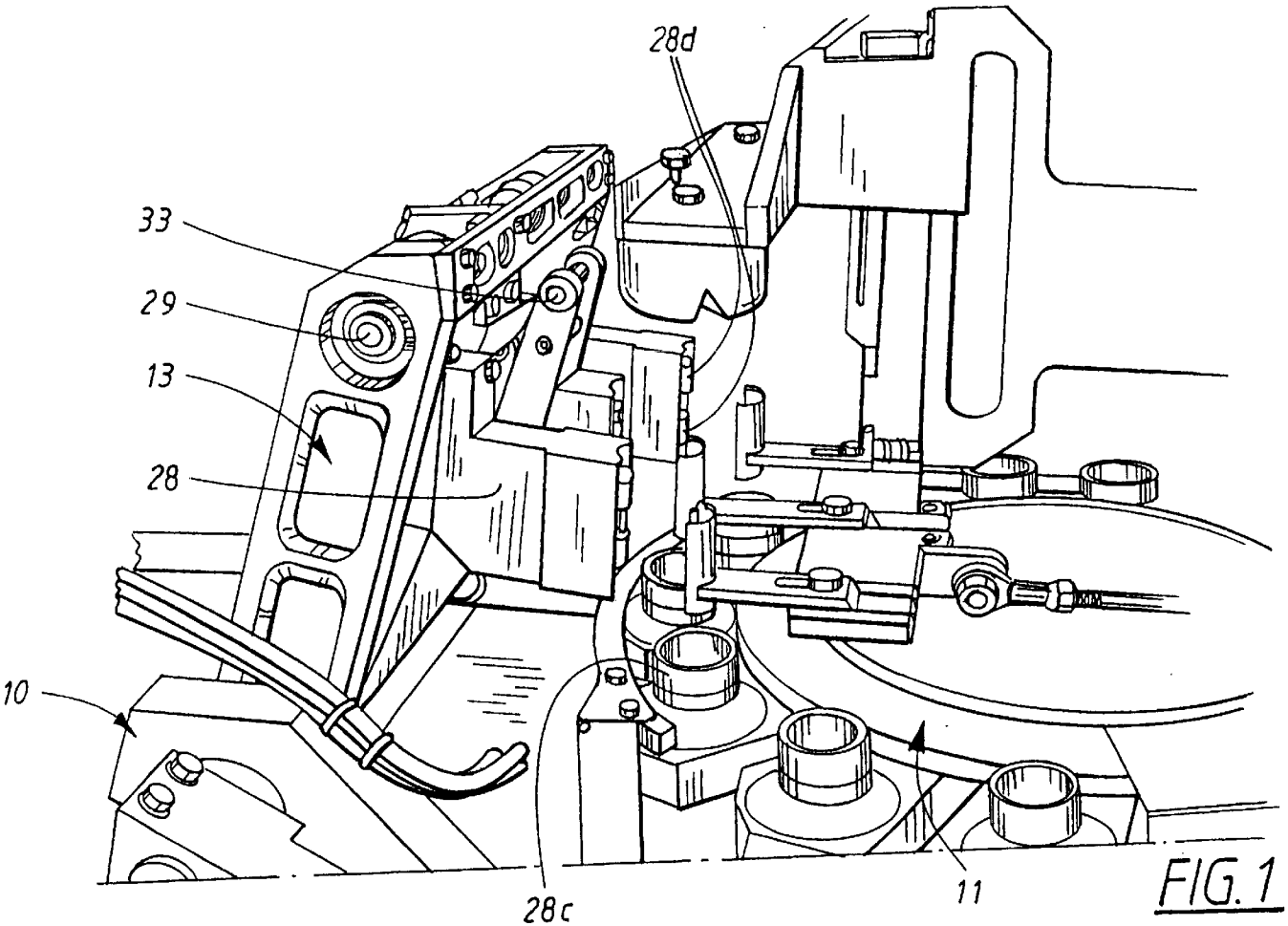
FIG. 1 shows, in a partial perspective view, from the side, a transfer arrangement according to the invention in position for picking up tubes (not shown) from an intermittently operating filler.
Figure 2:
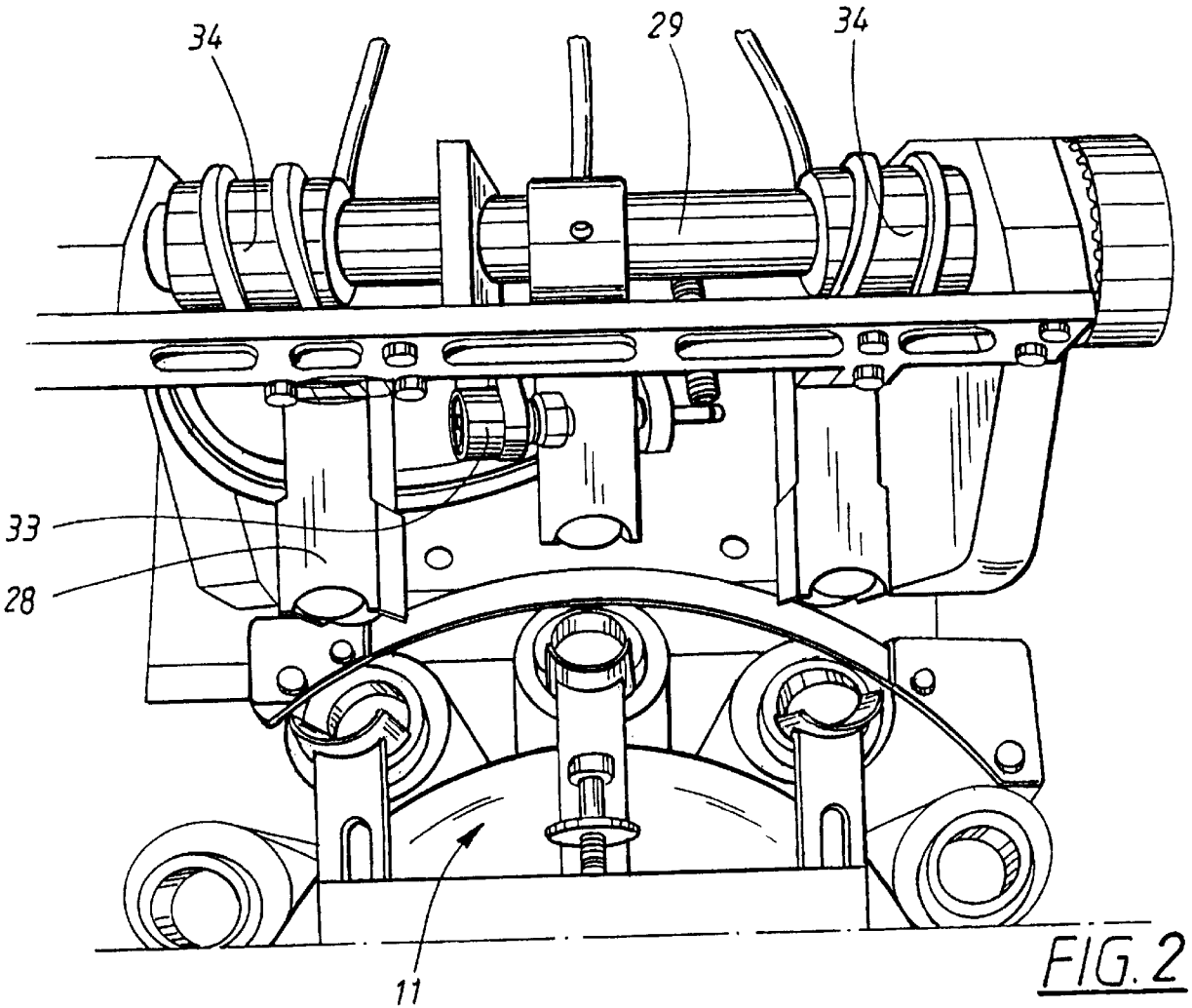
FIG. 2 shows the transfer arrangement from FIG. 1 in a partial perspective view, seen from above, and in the position according to FIG. 1.
Figure 3:
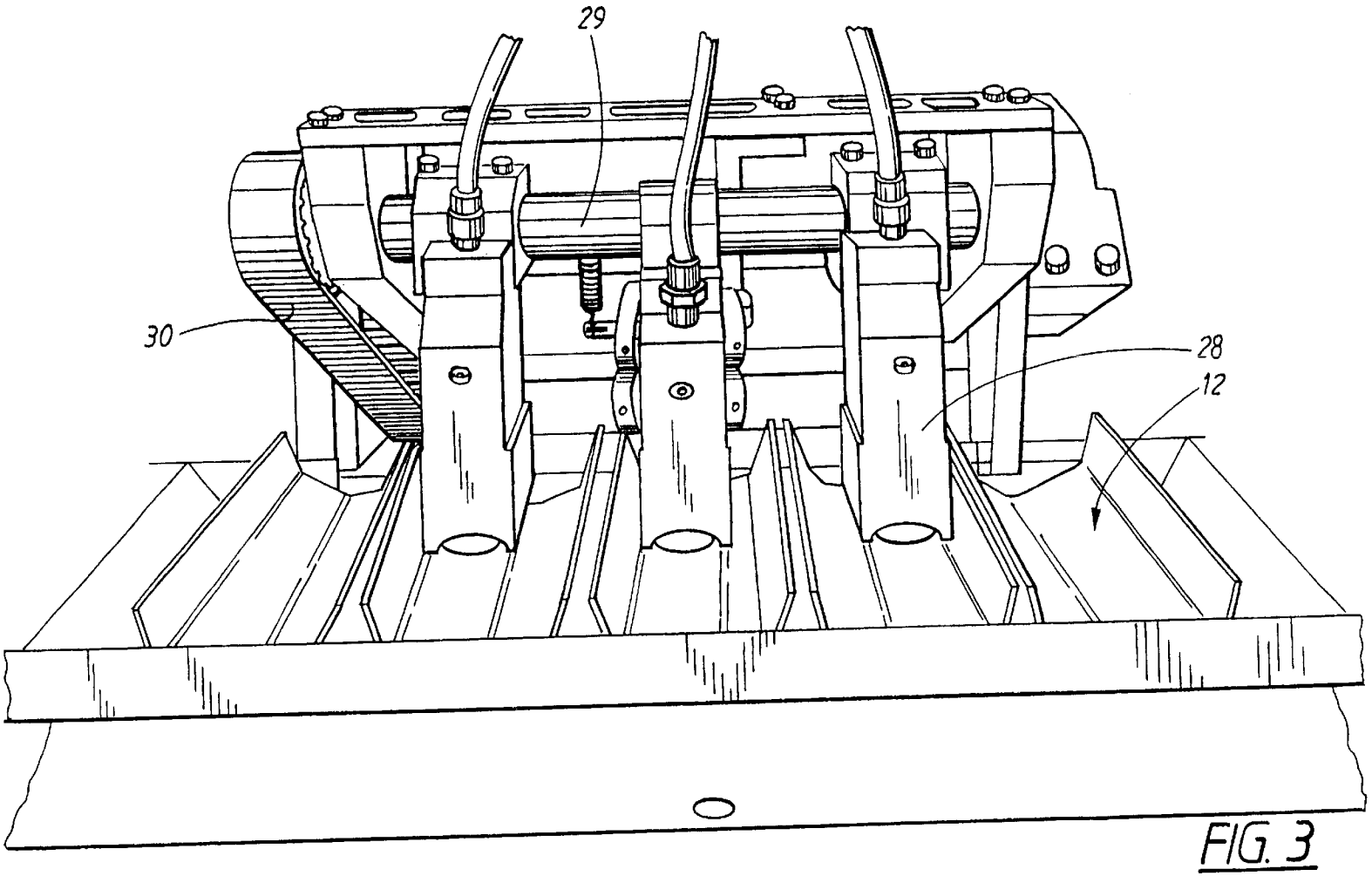
FIG. 3 shows the transfer arrangement in position for releasing tubes to a continuously driven conveyor in a cartoning machine.

After this intermediate position, the frame arrangement and associated parts return to the positions which are shown in FIG. 1. Although the pivoting/tilting movement of the frame arrangement is shown in different phases in FIGS. 1 to 11, it will of course be appreciated that this movement takes place in one sequence and very quickly. Since the tubes are held in place positively throughout the entire pattern of movement, secure and correct handling is guaranteed at very high speeds.

Although the invention has been described with reference to one illustrative embodiment, it will be appreciated that the inventive concept according to the attached patent claims can be applied in contexts other than packaging tubes. For example, the transfer arrangement can be used between all sorts of units in a packaging line where synchronizing between different patterns of movement is required. However, an important feature in this connection is that the container pickers/placers are given a suitable acceleration course at the final stage in order to achieve the desired synchronizing. The tubes do no necessarily need to be tilted from a vertical to a fully horizontal position, from pick-up to release, although this is preferable.

The invention is thus limited only by what is set out in the attached patent claims.

What is claimed is:

1. A method for transferring packaging containers from a first unit operating intermittently along a first horizontal path to a second unit operating at a continuous speed along a second horizontal path comprising:

arranging a plurality of container transfer mechanisms on a frame which is adapted to be pivoted about a first horizontal axis from a container pick-up position forward toward a container release position and then back to the container pick-up position;

gripping a number of containers in said first horizontal path; and, accelerating said frame about a vertical axis during its pivoting movement to said container release position such that the speed of the container transfer mechanisms in said container release position corresponds to said continuous speed of said second unit.

2. The method of claim 1, further comprising moving the container transfer mechanisms to a mutual spacing corresponding to a mutual container spacing in the second unit during the pivoting movement of the frame forward to the container release position.

3. The method of claim 2, wherein the first horizontal path comprises a partially circular path portion where the containers are picked up, said method further comprising compensating, during the pivoting movement, for differences in height arising from the pivoting movement, between the containers picked up from the partially circular path portion.

4. The method according to claim 1, wherein the containers are oriented vertically in the first horizontal path, said method further comprising arranging the transfer mechanisms to pivot in the frame about a second horizontal axis parallel to the first horizontal axis such that movement about the second horizontal axis in combination with the pivoting movement about the first horizontal axis results in the containers arriving horizontally at the second horizontal path.

5. A method of transferring filled tubes from a tube filler provided with a plurality of filling nozzles operating in a horizontal, at least partially circular path, to a cartoning machine operating at a continuous speed comprising:

arranging a plurality of tube transfer mechanisms on a frame adapted to pivot about a first horizontal axis from a tube pick-up position forward to a tube release position and back to the tube pick-up position;

gripping a number of filled tubes in the at least partially circular path of the tube filler;

accelerating the frame about a vertical axis during its pivoting movement to the tube release position such that the speed of the tube transfer mechanisms in the release position corresponds to the speed of the cartoning machine;

moving the tube transfer mechanisms to a mutual spacing corresponding to a mutual spacing in the cartoning machine; and, compensating for differences in height arising from the pivoting movement between the tubes picked up from the partially circular path.

6. The method of claim 5, further comprising arranging the tube transfer mechanisms to pivot in the frame about a second horizontal axis parallel to the first horizontal axis such that movement about the second horizontal axis in combination with the pivoting movement about the first horizontal axis results in the tubes arriving horizontally at the cartoning machine.

7. The method of claim 5, further comprising positively holding the tubes by force by the transfer mechanisms during the entire pivoting movement of the frame forward to the release position.

8. The method of claim 5, further comprising pivoting the frame during a first phase of its pivoting movement to an intermediate position such that the frame during this first phase of movement is turned a predetermined angle about the vertical axis, wherein the frame arrangement, during a succeeding second phase of its pivoting movement, forward to the tube release position, executes the accelerating movement during a turning movement in a direction counter to the first, but with the same angle of turning.

9. The method of claim 5, wherein the frame moves in a patterned movement inverse to the patterned movement leading to the release position after releasing the filled tubes to the cartoning machine, the patterned movement comprising deceleration of the turning movement about the vertical axis, resetting of the frame to the starting position relative to the vertical axis and the horizontal axes, and resetting of the tube transfer mechanisms to the starting position.

10. The method of claim 5, wherein all movements are generated by mechanically operated cam guides.

11. The method of claim 5, wherein the gripping, holding and releasing of the tubes is by transfer mechanisms operating with a vacuum.

12. An apparatus for transferring filled tubes from a tube filler having a plurality of filling nozzles and operating intermittently in a horizontal and at least partially circular path to a continuously operating cartoning machine comprising:

a frame supported in a stand outside of the filler's at least partially circular path, wherein said frame is adapted to pivot about a first horizontal axis and turn about a vertical axis;

tube transfer mechanisms arranged in the frame;

a pivoting mechanism for pivoting the frame from a tube pick-up position forward to a tube release position and back to the tube pick-up position;

a turning mechanism for turning the frame about the vertical axis and accelerating said tube transfer mechanisms over an acceleration course during the pivoting movement of said frame forward to the tube release position; and, an arrangement for triggering and controlling the acceleration over the acceleration course such that said tube transfer mechanisms are synchronized with the cartoning machine.

13. The apparatus of claim 12, further comprising:

a moving mechanism which, during the pivoting movement of said frame to the tube release position, moves said tube transfer mechanisms to a mutual spacing corresponding to a spacing in the cartoning machine; and, a compensation mechanism for compensating differences in height, occasioned by the pivoting movement, between the tubes picked up from the at least partially circular path of the filler, such that a set of tubes lying in a straight line is released to the cartoning machine.

14. The apparatus of claim 13, wherein the pivoting mechanism comprises a radially acting cam guide driven by a drive shaft mounted in said stand and said turning mechanism for the turning movement of the frame comprises an axial cam guide driven by the same drive shaft.

15. The apparatus of claim 14, wherein said tube transfer mechanisms are supported pivotably in said frame on a second horizontal axis defining a second pivot axis parallel to said first horizontal axis.

16. The apparatus of claim 15, wherein a spring-loaded articulated rod is driven for vertical upward and downward movement from said drive shaft via said radial cam guide and is connected in an articulated manner to a rotationally fixed arm on a first supporting horizontal shaft which supports said frame in a pivotable manner and defines the first horizontal axis.

17. The apparatus of claim 16, wherein said frame further comprises a vertical shaft defining said vertical axis and connected in a rotationally fixed manner to a second arm controlled by said axial cam guide.

18. The apparatus of claim 16, further comprising a cam belt arranged to transmit the movement of said articulation rod from said first supporting horizontal shaft to a second supporting horizontal shaft.

19. The apparatus of claim 18, wherein said second supporting horizontal shaft comprises axial guides for heels supporting said tube transfer mechanisms, said heels adapted such that the turning of said second supporting horizontal shaft, generated by said cam belt, during the pivoting movement of said frame forward to the tube release position, sets said tube transfer mechanisms in a position corresponding to spacing in the cartoning machine.

20. The apparatus of claim 19, wherein at least one of said heels is articulated for the purpose of generating said height compensation.

21. The apparatus of claim 20, wherein a guide, provided with said axial guide and extending parallel to said second supporting horizontal shaft, controls said heels.

22. The apparatus of claim 21, wherein three tube transfer mechanisms are supported by said second supporting horizontal shaft and said guide, of which a central transfer mechanism is fixed, centrally positioned and articulated parallel to said horizontal pivoting axes, while outer transfer mechanisms are adapted to be axially displaced by said axial guide.

23. The apparatus of claim 22, wherein the articulation is designed such that, in the pick-up position, said central tube transfer mechanism and said two outer tube transfer mechanisms lie on an imaginary arc of a circle corresponding to the partially circular filler path.

24. The apparatus of claim 23, wherein each tube transfer mechanism has a cupped tube-securing surface provided with vacuum openings.

25. The apparatus of claim 24, wherein said vacuum openings of said tube-securing surface are arranged to be active during the entire pivoting movement of the frame arrangement from the pick-up position to the release position.

* * * * *